United States Patent [19]

Bou-Mikael et al.

[11] Patent Number: 4,819,724

[45] Date of Patent: Apr. 11, 1989

[54] MODIFIED PUSH/PULL FLOOD PROCESS FOR HYDROCARBON RECOVERY

[75] Inventors: Sami Bou-Mikael, Kenner, La.; Robert B. Alston, Missouri City; Donald L. Hoyt, Houston, both of Tex.

[73] Assignee: Texaco Inc., White Plains, N.Y.

[21] Appl. No.: 92,750

[22] Filed: Sep. 3, 1987

[51] Int. Cl.[4] ..... E21B 43/00

[52] U.S. Cl. ..... 166/263; 166/266

[58] Field of Search ..... 166/263, 268, 273, 274, 166/266, 267

[56] References Cited

U.S. PATENT DOCUMENTS

| | | | |
|---|---|---|---|
| 3,123,134 | 3/1964 | Kyte et al. | 166/263 |
| 3,252,512 | 5/1966 | Baker et al. | 166/263 |
| 3,266,569 | 8/1966 | Sterrett | 166/263 |
| 3,280,909 | 10/1966 | Closmann et al. | 166/263 |
| 3,330,342 | 7/1967 | Holm | 166/263 |
| 3,480,081 | 11/1969 | Felsenthal | 166/263 |
| 4,217,956 | 8/1980 | Goss et al. | 166/263 X |
| 4,234,291 | 4/1982 | Wong et al. | 166/272 X |
| 4,390,068 | 6/1983 | Patton et al. | 166/267 |
| 4,418,753 | 12/1983 | Morel et al. | 166/268 X |
| 4,683,948 | 8/1987 | Fleming | 166/263 |

*Primary Examiner*—Bruce M. Kisliuk

*Attorney, Agent, or Firm*—Jack H. Park; Kenneth R. Priem; Harold J. Delhommer

[57] ABSTRACT

The invention comprises injecting about 5% to about 25% pore volumes of a recovery fluid simultaneously into an underground formation through at least two wells. One well which is destined to be the production well is shut-in for a soak period of about one to about 60 days while injection of the recovery fluid is continued through the second well. The shut-in well is then converted to a production well and hydrocarbons and other fluids are produced from the production well while recovery fluid is injected through the second well. The shut-in well is then converted to a production well and hydrocarbons and other fluids are produced from the production well while recovery fluid is injected through the second well.

20 Claims, 1 Drawing Sheet

MODIFIED PUSH/PULL FLOOD PROCESS FOR HYDROCARBON RECOVERY

BACKGROUND OF THE INVENTION

This invention is concerned with the recovery of underground hydrocarbons by the injection of a gaseous recovery fluid. More particularly, the invention pertains to the use of at least two wells, one of which is employed as a continuous injection well, and a second well which is operated in a cyclic injection and production manner.

Several methods of enhanced oil recovery have involved the injection into an underground formation of a gaseous solvent such as carbon dioxide. The injected fluid may be injected at conditions so as to make the fluid miscible or conditionally miscible with the underground hydrocarbons. Numerous tests have been performed in the field with the injection of carbon dioxide through one or more injection wells to drive underground hydrocarbons to one or more producing wells.

Cyclic oil recovery processes wherein injection and production of fluids takes place through the same well are also known in the art. One of the earliest disclosures of a cyclic oil recovery process was in U.S. Pat. No. 3,480,081 wherein the flooding medium was water, brine or steam. The success of steam cyclic recovery processes inevitably lead to the injection of carbon dioxide in a cyclic or push/pull process wherein carbon dioxide was injected into an individual well, allowed to soak, and then produced. U.S. Pat. No. 4,390,068 discloses such a carbon dioxide cyclic process. Cyclic carbon dioxide recovery has now become a commonplace event in the oil field.

Attempts to recover heavy oils and hydrocarbons from tar sands have lead to a number of processes involving the injection of various solvents and hot fluids in "pressurization and drawdown methods." These are similar to cyclic carbon dioxide methods in that various solvents and fluids are injected into the formation through a well to increase formation pressure. The fluids may or may not be allowed to soak in the formation prior to producing the injected fluids along with hydrocarbons through the same well. U.S. Pat. No. 4,324,291 is one example of these processes.

SUMMARY OF THE INVENTION

The invention is a method for recovering hydrocarbons from underground hydrocarbon formations penetrated by at least two wells, which comprises injecting a recovery fluid simultaneously into an underground formation through at least two wells until sufficient recovery fluid has been injected to fill about 5% to about 25% of the reservoir pore volume between the two wells. One well which is destined to be the production well is shut-in for a soak period of about one to about 60 days while injection of the recovery fluid is continued through the second well. The shut-in well is then converted to a production well and hydrocarbons and other fluids are produced from the production well while recovery fluid is injected through the second well.

The invention method is preferably employed with a well pattern having five wells, seven wells, or more. In a five or seven well pattern, the relatively central well will preferably be the continuous injection well. The remaining wells will preferably be the wells subject to injection, shut-in and soak, and production. However, the invention can be practiced with as few as two wells. Naturally sealing fault lines may be employed around the two wells to limit and direct the spread of injected recovery fluid.

DETAILED DESCRIPTION

Figure 1:
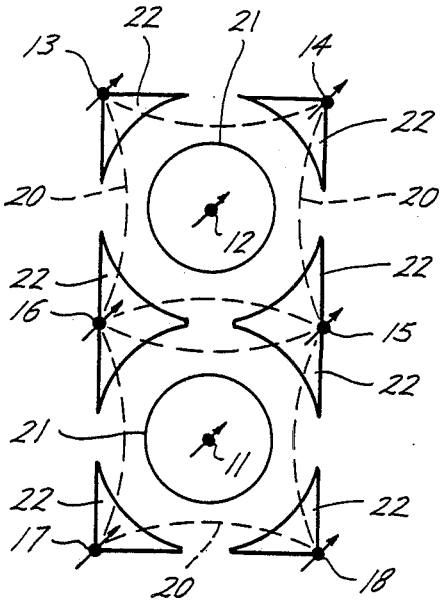
FIG. 1 illustrates the invention method practiced on two adjacent 5-spot patterns after the initial injection step.

A chief objective in tertiary flooding is to reduce the volume of reservoir unswept by the flooding medium. Of course, the location and the volume of the unswept area varies according to the well pattern and recovery method employed. The instant invention offers a novel approach to reducing the volume of unswept reservoir as well as reducing "dead time" and increasing the type and number of reservoirs which can be efficiently swept by a flooding medium.

In any conventional tertiary flood, there is a period of time appropriately called "dead time" between the initiation of injection and the production of oil. In most cases, this amounts to many months, and often years. The invention method reduces this dead time to a matter of several weeks or months before hydrocarbons are produced from the production wells that are subject to the push/pull cycle.

Furthermore, the shifting of rock layers has created numerous small oil reservoirs generally bounded by faults or aquifers. Individually, the oil-in-place may be only about 1 to 10 million barrels, and the cost of recovery, especially in deeper zones, may be so high as to make the reservoirs border-line candidates at best for flooding after primary or secondary recovery. The present invention offers a method to reduce the unswept areas in such small bounded reservoirs, making it economically feasible to recover hydrocarbons from many such reservoirs.

The invention is a method for recovering hydrocarbons from underground hydrocarbon formations penetrated by two or more wells. A recovery fluid selected from the group consisting of carbon dioxide, nitrogen, sulfur dioxide, methane, ethane, propane, butane and mixtures thereof is injected simultaneously through all of the wells employed in the invention method until about 5% to about 25%, preferably about 5% to about 15% pore volumes of recovery fluid has been injected.

One or more wells, preferably a centrally located well, is selected to be a continuous injection well. The other wells (one well in a two well pattern) are shut-in for a soak period of about one to about 60 days, preferably four to about 30 days, while continuing the injection of recovery fluid through the continuous injection well. After the soak period, the shut-in well is then converted to a production well. Hydrocarbons and other fluids are produced from the production well or wells while continuing to inject recovery fluid through the continuous injection well or wells.

The invention method can be practiced with two wells, particularly if the wells are tightly bounded by sealing fault lines or an aquifer to limit the spread of recovery fluid away from the production well. The method can also be practiced with any number of wells larger than two. Repeating patterns of 5-spot well patterns or 7-spot well patterns are particularly appropriate for the invention method. Of course, the larger the ratio of production wells to injection wells, the more appropriate it is to increase the injection rate through the well or wells serving as the continuous injection well.

A three well pattern can be used to practice the invention in which one or two wells may be used as the continuous injection well or wells. The remaining wells are shut in after simultaneous injection and later produced.

The recovery fluid of choice is carbon dioxide. But other recovery fluids that are gaseous at standard temperature and pressure such as nitrogen, sulfur dioxide and low molecular weight hydrocarbons such as methane through butane and LPG may be employed. Preferably the recovery fluid will be injected at conditions at which it is miscible or conditionally miscible with the underground hydrocarbons. But this is not necessary. Although carbon dioxide is frequently used herein, it should be understood that other normally gaseous recovery fluids may be employed instead of carbon dioxide.

Carbon dioxide is initially injected into all of the wells, at relatively high rates until approximately 5% to about 25% of a pore volume has been injected. The injection rate should be on the order of about 1 to about 20 million standard cubic feet a day. For convenience, the recovery fluid may also be injected as a supercritical fluid, or in a liquid state, as it will flash to a gas within the reservoir.

The continuous injection well, usually the most centrally located well, should have the highest injection rate. An injection rate through the continuous injection well of about twice the average well injection rate is preferred.

Use of high injection rates, particularly where the injection rate drives the carbon dioxide through the formation at a velocity greater than critical velocity, promotes fingering. For a discussion of critical velocity, please see U.S. Pat. Nos. 3,811,503; 3,878,892; 4,136,738; 4,299,286; 4,418,753; and 4,434,852, the disclosures of which are incorporated herein by reference. A carbon dioxide velocity which exceeds critical velocity is normally undesirable. However in this particular method, fingering is beneficial as the reservoir volume invaded by the carbon dioxide is increased, allowing more residual oil to be contacted by the carbon dioxide. In general, experience has shown us that the volume actually invaded by carbon dioxide at high injection rates will be about three to about five times the actual reservoir volume of carbon dioxide injected. Thus, about 5% to about 15% of injected pore volume at sufficiently high injection rates can invade about 15% to as much as 75% of the reservoir volume.

The simultaneous injection into all wells increases a real sweep efficiency by forcing the recovery fluid to invade areas between the wells and the pattern boundaries formed by sealing faults or aquifers or injected recovery fluid in adjacent well patterns. This effect is enhanced by the continuous central injection which reacts with the injected fluid of the outer wells in such a way as to distort their individually swept areas toward the boundaries, thereby further increasing invasion of these difficult to reach areas where oil saturation is highest.

Furthermore, the method increases vertical sweep efficiency in multilayered reservoirs having isolating shale breaks between reservoir layers. Simultaneous injection through all wells will create a higher reservoir pressure in a high permeability layer than in a low permeability layer. Continued injection should divert more recovery fluids to the lower permeability, lower pressured reservoir layer.

The injection into all wells may also help to repressurize the reservoir up to or near original pressure. If this pressure is high enough that miscibility or conditional miscibility can be achieved with the recovery fluid, recovery will be further improved, resulting in lower residual oil saturations.

Shutting in all the wells except the continuous injection well or wells allows the injected carbon dioxide time to contact additional residual oil by diffusion, as well as time to dissolve into the oil to swell it and reduce its viscosity. Continuing to inject recovery fluid through the continuous injection well maintains reservoir pressure and improves swelling, viscosity reduction and the potential for attaining miscibility or conditional miscibility. Continued injection also serves to push carbon dioxide farther into the high oil saturation regions not reached by previous recovery processes.

After a soaking time period of about one to about 60 days, preferably about four to about 30 days, the shut-in wells are reopened for production while injection is continued through the central well. It is preferred to control production so that the production wells will not immediately blow down and so that the total voidage of oil and gas from the production wells approximately equals the injection rate through the central well or wells. Production rates may also be increased to reduce production time and allow for increased production at an earlier stage. If it is desired to increase pressure, injection rates may also be increased above production rates during this phase.

Placing the outer wells on production has some of the aspects of a push/pull or cyclic procedure, in that each well initially produces oil from the volume invaded by previous injection through the same well. However, there are some significant differences. Much of the produced oil is from regions of high saturation that would not have been reached without the aid of the continuous central injection. In a preferred embodiment, the producing wells are not blown down as in a conventional push/pull process. Consequently the production wells will have an additional driving force available from the central injection well. This extra driving force maintains pressure, and hence maintains miscibility, swelling, reduced viscosity, and increases production rates. It also helps displace the mobilized oil and the vapor-saturated gas toward the production wells.

In effect, we have developed a push/pull flood which synergistically combines the effects of individual cyclic procedures in an operational field flood to improve both the horizontal and the vertical sweep efficiencies. As a further advantage, the dead time before production has been reduced to the time needed for initial injection plus a soak period. Not only does production occur sooner, but all the wells produce together, maximizing production early in the project. Earlier production is desirable because it improves project economics.

If desired, multiple push/pull cycles can be applied to the producing wells with various slug sizes until the recovery fluid from the continuous injection well reaches the production wells. Larger injected volumes through the push/pull wells will affect more of the reservoir volume and may require fewer cycles before merging with the injected recovery fluid from the continuous injection well. However, smaller slug volumes will allow for more immediate production and cash flow, which at times may be more important.

Unless a very inexpensive supply of recovery fluid is available, it is desirable to recycle the produced recovery fluid for further injection. This involves separating the recovery fluid such as carbon dioxide from the produced fluids and reinjecting the separated recovery fluid through an injection well.

After the recovery fluid from the central continuous injection well has broken through at the production well, and it is determined that the economic recovery limit has been reached for the pattern and a selected quantity of hydrocarbons has been produced, continuous injection should be discontinued and the choke valves on the production wells opened up to allow the production wells to be blown down.

Figure 2:
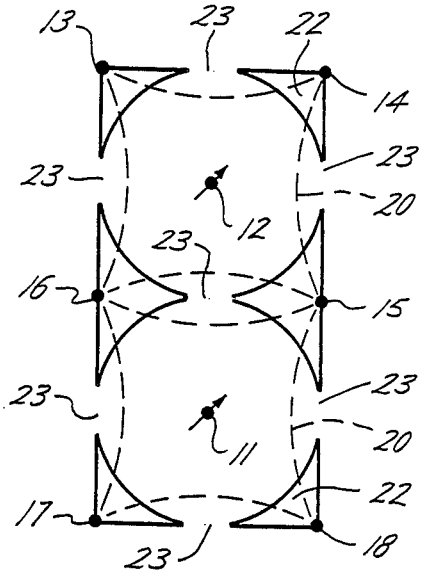
FIG. 2 illustrates the two adjacent 5-spot well patterns of FIG. 1 after breakthrough of carbon dioxide from the central injectors.

FIGS. 1–4 illustrate various aspects of the invention method. In FIGS. 1 and 2, two adjacent 5-spot well patterns are used to illustrate the recovery method wherein the recovery method is applied to a field containing more than the two 5-spot well patterns pictured.

Relatively central continuous injection wells 11 and 12 are shown with each surrounded by four corner wells which initially serve as injection wells, and then production wells. The push/pull wells are identified at 13, 14, 15, 16, 17 and 18. Dashed line 20 illustrates the area of the two patterns previously swept by waterflood. In FIG. 1, the solid line 21 surrounding injection wells 11 and 12 illustrates the area invaded by carbon dioxide injection through injection wells 11 and 12 prior to shutting in the corner wells. The roughly triangular areas 22 near the corner wells 13, 14, 15, 16, 17 and 18 illustrate the area invaded by carbon dioxide injected through the push/pull wells. It should be noted that the carbon dioxide injected through the push/pull wells will not invade the formation in a roughly radial manner because of the forces exerted by the radial injection from the continuous injection wells 11 and 12.

After the injection through all of the wells, the corner wells 13, 14, 15, 16, 17 and 18 are shut-in and injection is continued through the continuous injection wells 11 and 12. FIG. 2 illustrates the swept areas of the patterns at carbon dioxide breakthrough at the corner wells. Generally the only unswept areas of the two 5-spot patterns will be the small, roughly triangular areas 23.

Figure 3:
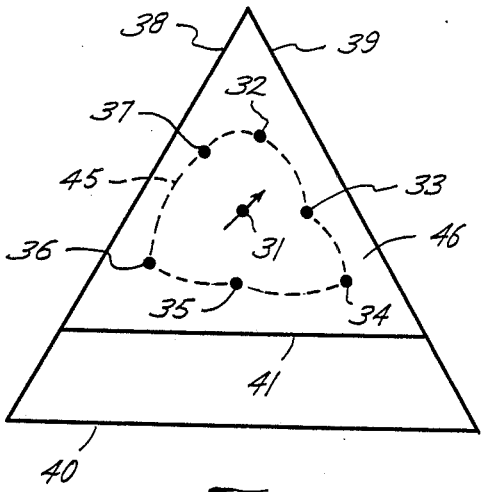
FIG. 3 illustrates a 7-spot well pattern located in a tightly bounded after waterflooding.
Figure 4:
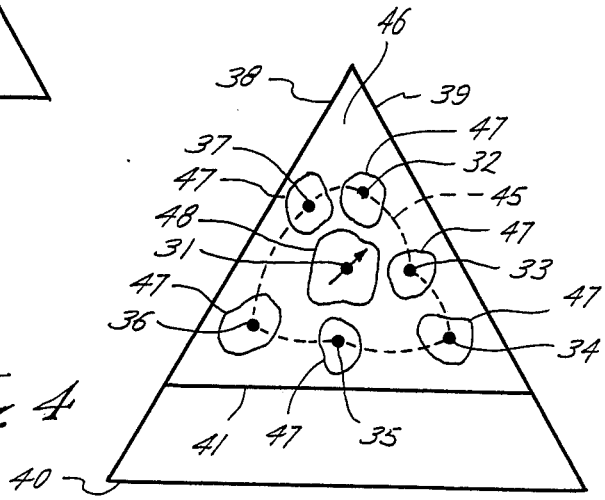
FIG. 4 illustrates the 7-spot well pattern of FIG. 3 after the initial injection phase of the invention method.

FIGS. 3 and 4 illustrate a 7-spot well pattern within a small reservoir bounded by faults 38, 39, 40 and water-/oil contact 41. The continuous injection well 31 is surrounded by production wells 32, 33, 34, 35, 36 and 37. The irregular solid line 45 linking the production wells generally shows the area previously swept by waterflood. The unswept hydrocarbon area 46 is located between the waterflood sweep line 45 and the fault boundary lines 38, 39 and 41.

FIG. 4 illustrates this representative pattern at the end of the initial injection phase. Roughly circular areas 47 illustrate the area of the formation invaded by carbon dioxide from the injection through the six wells 32, 33, 34, 35, 36 and 37. Roughly circular area 48 illustrates the area swept by carbon dioxide from the continuous injection well 31.

The following examples further illustrate the novel production method of the present invention. These examples are given by way of illustration and not as limitations on the scope of the invention. Thus, it should be understood that the above described procedures may be varied to achieve similar results within the scope of the invention.

EXAMPLES 1–3

The following examples illustrate the oil recovery advantage of the invention method in a small reservoir such as the one depicted in FIGS. 3 and 4. The reservoir has an assumed area of 100 acres and a pore volume of $10\times10^6$ reservoir barrels of oil (RBO). Waterflood has been completed and the advance of injected water is shown by the dashed line. This has resulted in an areal sweep of about 70%, and a recovery of about 56% of the oil in place, with a residual oil saturation of about 30% in the swept areas and about 80% in the unswept areas.

Assuming typical values for sweeps, residual oil saturations, and injection rates, we have calculated that a conventional carbon dioxide flood, injected into the central well would recover an additional 1.4 million reservoir barrels of oil.

Using the same residual saturations and injection rates, and assuming that half of the carbon dioxide injected into each of the outer wells invades the volume between the wells and the boundaries, we calculate that our invention procedure would recover an additional 2.24 million reservoir barrels of oil, or 60% more than the conventional flood. Even assuming a higher residual saturation in the newly swept areas of 20%, the method recovers an additional 2.12 million reservoir barrels of oil, or 51% more oil. Recovery calculations are shown below.

Area = 100 acres; Waterflood: 70% Swept (=Vs); 30% Unswept (=Vu)

PV = $10\times10^6$ RB; $S_{orw}\approx30\%$; $S_{oi}=80\%$; $S_{orC02}\approx10\%$.

00IP = 80% × 10 MMRB = 8 MMRBO.

Vol Swept − 70% × 10 MM = 7 MMRB; Vu = 3MMRB.

Vol Remaining − Qr = 30% × 7 + 80% × 3 = 2.1 + 2.4 = 4.5 MMRBO.

Vol Oil Recovered = 8 − 4.5 = 3.5 MMRBO by waterflood.

Recovered = 3.5/8 = 43.75% by waterflood.

I. Straight $C0_2$ Flood: Inject & recycle for ≈1 PV injection.

A. Vol. invaded ≈ WF invasion = 7 MMRB.

B. Oil remaining = 10% × 7 + 80% × 3 = 0.7 + 2.4 = 3.1 MMRB.

C. OIP at start of $CO_2$ = 2.1 + 2.4 = 4.5. BOR = 4.5 − 3.1 = 1.4 MMRBO.

D. Recovery efficiency as % of OOIP = (4.5 − 3.1)/ = 17.5%.

Recovery efficiency as % of OIP = 1.4/4.5 = 31.1% = $E_R$.

E. Time to response:

Well distance to median well = 1100 ft.

Well distance from central well ranges between 740 and 1810 ft.

Assume radial flow to well $$\frac{A}{A_{Total}}(PV) = \frac{\pi \frac{550^2}{370^2} - 43.560}{100}(10\ MMRB).$$

Invaded PV to medium well=21.8% PV=2.18 MMRB.

Invaded PV to nearest well=9.8% PV=0.982 MMRB.

Assume: Invasion factor of 3: Injected PV=0.327 MMRB to nearest well.

Injected PV=$\frac{1}{3}$ Inv. PV=0.727 MMRB to median well.

Assume: Central injector can inject 4000 RB/D.

$$\frac{327\ MRB}{4\ MRB} = \text{Time to nearest well} = 82 \text{ days.}$$

But time to median well $$\approx \frac{727\ MRB}{4\ MRB/D} = 182 \text{ days.}$$

Time for response to farthest well: About 492 days if no production is taken from intermediate wells. But this doesn't happen. Therefore, the last or farthest well often doesn't respond at all because so much of the central injection is taken up by intermediate wells.

II. Push/Pull Flood:

A. Injection Phase: Inject 16% PV into 7 wells at 2000 RB/D in outer wells (6 wells) and 4000 RB/D in central well.

Total=16000 RB/D.

16%=0.16×10 MMRB=1.6 MMRB. n $$\text{Time to inject} = \frac{1600\ MBB}{16\ MRB/D} = 100 \text{ days.}$$

Assume Invasion factor of 3: Invaded PV=48% distributed as 6% PV invaded around each of 6 outer wells (=36%) plus 12% PV invaded around central well.

B. Shut In Phase: Assume 15 days.

Central injector reduced to 1000 RB/D --- 15 MRB injected This increased PV injected to only 16.15%, and increases PV invaded to 48.45%.

C. Production Phase: After total of 115 days, place all 6 wells on production. This compares to only 3 after 180 days in straight flood case.

Recovery: Assume same residual saturations as for straight flood: 10% $S_{orCO2}$ in invaded area and 80% $S_o$ in uninvaded area.

Continue injection in central well until 1 PV injected, as in other case.

(1) Vol. invaded: Assume $\frac{1}{2}$ of injected fluid in each outer well invades area between well and boundary. Assume all central area invaded. Then Vol. invaded=$\frac{1}{2}$×6%=3% of fresh volume for each well=12% fresh invasion plus central areas.

(2) Vol. invaded=70% of straight flood+12%. New Vol. invaded=82% or 8.2 MMRB; 7 MMRB as before+1.2 MMRB new recovery.

Oil remaining=10% of 8.2+80% of 1.8=0.82+1.44=2.26 MMRBO.

Oil at start of flood = 4.5 *MMRBO;*

-continued $$E_R = \frac{4.5 - 2.26}{4.5} = 49.8\%.$$

Enhanced BOR=2.24 MMRBO or 60% more than for straight flood.

Dead time: 115 days to production from all 6 wells vs. production from only 1 wells in conventional flood.

Assuming $S_{orCO2}$=20% in the newly swept regions (1.2 MMRB).

Oil remaining=10% of 7+20% of 1.2+80% of 1.8=2.38 MMRBO.

Enhanced BOR=4.5−2.38=2.12 MMRBO.

This is still 2.12/1.4=151% of BOR in conventional flood.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A method for recovering hydrocarbons from an underground hydrocarbon formation penetrated by at least two wells, which comprises:

injecting a recovery fluid into an underground formation simultaneously through at least two wells until about 5% to about 25% pore volumes of recovery fluid has been injected, said recovery fluid selected from the group consisting of carbon dioxide, nitrogen, sulfur dioxide, methane, ethane, propane, butane and mixtures thereof;

shutting in one well of the two wells for a soak period of about one to about 60 days while continuing injection of recovery fluid through the second well;

converting the shut in well to a production well; and producing hydrocarbons and other fluids from the production well while continuing to inject recovery fluid through the second well.

2. The method of claim 1, further comprising:

injecting about 5% to about 25% pore volume of recovery fluid simultaneously through at least three wells prior to shutting in one of the three wells;

continuing injection of recovery fluid through said second well and a third well; and producing hydrocarbons and other fluids from the previously shut in well while continuing to inject recovery fluid through the second and third wells.

3. The method of claim 1, further comprising:

injecting about 5% to about 25% pore volume of recovery fluid simultaneously through at least three wells prior to shutting in two of the three wells;

continuing injection of recovery fluid through said second well; and producing hydrocarbons and other fluids from the previously shut in wells while continuing to inject recovery fluid through said second well.

4. The method of claim 1, further comprising:

injecting recovery fluid simultaneously through all five wells in a five well pattern;

using one relatively central well of the five wells as a continuous injection well; and shutting in and later producing hydrocarbons and other fluids from the other four wells while continuing to inject recovery fluid through the continuous injection well.

5. The method of claim 1, further comprising:

injecting recovery fluid simultaneously through all seven wells in a seven well pattern;

using one relatively central well of the seven wells as a continuous injection well; and shutting in and later producing hydrocarbons and other fluids from the other six wells while continuing to inject recovery fluid through the continuous injection well.

6. The method of claim 1, wherein the hydrocarbon formation has been previously waterflooded.

7. The method of claim 1, further comprising injecting a recovery fluid which is miscible with the underground hydrocarbons.

8. The method of claim 1, further comprising injecting a recovery fluid which is conditionally miscible with the underground hydrocarbons.

9. The method of claim 1, further comprising separating the recovery fluid from the produced fluids and reinjecting the separated recovery fluid through an injection well.

10. The method of claim 1, further comprising injecting the recovery fluid in a liquid state.

11. The method of claim 1, further comprising injecting the recovery fluid through the second well at a higher injection rate than the injection rate through the well to be later shut in.

12. The method of claim 1, further comprising injecting the recovery fluid through the wells at an injection rate sufficient to force the recovery fluid to move through the formation at a velocity greater than critical velocity.

13. The method of claim 1, further comprising injecting the recovery fluid through the wells at an injection rate of about one to about 20 million standard cubic feet per day per well.

14. The method of claim 1, further comprising injecting the recovery fluid through the second well at a higher rate than fluids are being produced from the formation.

15. The method of claim 1, further comprising injecting the recovery fluid through the second well at a rate to match the production rate of produced fluids and maintain a desired reservoir pressure.

16. The method of claim 1, further comprising converting the production well back to an injection well after a selected quantity of hydrocarbons has been produced;

injecting a recovery fluid through the well previously used for production;

shutting in the production well for a soak period of about one to about 60 days while continuing injection of recovery fluid through the second well; and producing hydrocarbons and other fluids from the production well while continuing to inject recovery fluid through the second well.

17. The method of claim 1, wherein the well is shut in for a period of about four to about 30 days.

18. A method for recovering hydrocarbons from an underground hydrocarbon formations penetrated by at least two wells, which comprises:

injecting carbon dioxide into an underground formation simultaneously through at least two wells until about 5% to about 15% pore volumes of carbon dioxide has been injected, said carbon dioxide being injected at an injection rate sufficient to force the carbon dioxide to move through the formation at a velocity greater than critical velocity;

shutting in one well of the two wells for a soak period of about four to about 30 days while continuing injection of carbon dioxide through the second well;

converting the shut in well to a production well; and producing hydrocarbons and other fluids from the production well while continuing to inject carbon dioxide through the second well.

19. A method for recovering hydrocarbons from an underground hydrocarbon formation penetrated by a well pattern comprising five wells, which comprises:

injecting carbon dioxide into an underground formation simultaneously through all five wells in a five well pattern until about 5% to about 15% pore volumes of carbon dioxide has been injected, said carbon dioxide being injected at an injection rate sufficient to force the carbon dioxide to move through the formation at a velocity greater than critical velocity;

shutting in four wells of the five well pattern for a soak period of about four to about 30 days while continuing injection of carbon dioxide through a relatively central well of the five well pattern;

converting the shut in wells to production wells; and producing hydrocarbons and other fluids from the production wells while continuing to inject carbon dioxide through the relatively central well.

20. A method for recovering hydrocarbons from an underground hydrocarbon formation penetrated by a well pattern comprising seven wells, which comprises:

injecting carbon dioxide into an underground formation simultaneously through all seven wells in a seven well pattern until about 5% to about 15% pore volumes of carbon dioxide has been injected, said carbon dioxide being injected at an injection rate sufficient to force the carbon dioxide to move through the formation at a velocity greater than critical velocity;

shutting in six wells of the seven well pattern for a soak period of about four to about 30 days while continuing injection of carbon dioxide through a relatively central well of the seven well pattern;

converting the shut in wells to production wells; and producing hydrocarbons and other fluids from the production wells while continuing to inject carbon dioxide through the relatively central well.

* * * * *